US007340900B2

(12) United States Patent
Xu et al.

(10) Patent No.: US 7,340,900 B2
(45) Date of Patent: Mar. 11, 2008

(54) METHOD AND APPARATUS FOR DECREASING COMBUSTOR ACOUSTICS

(75) Inventors: Jun Xu, Mason, OH (US); Timothy James Held, Blanchester, OH (US)

(73) Assignee: General Electric Company, Schenectady, NY (US)

( * ) Notice: Subject to any disclaimer, the term of this patent is extended or adjusted under 35 U.S.C. 154(b) by 412 days.

(21) Appl. No.: 11/012,638

(22) Filed: Dec. 15, 2004

(65) Prior Publication Data

US 2006/0123792 A1 Jun. 15, 2006

(51) Int. Cl.
*F02C 1/00* (2006.01)
*F02G 3/00* (2006.01)

(52) U.S. Cl. ..... 60/737; 60/748

(58) Field of Classification Search ..... 60/737, 60/804, 39.37, 748
See application file for complete search history.

(56) References Cited

U.S. PATENT DOCUMENTS 5,251,447 A * 10/1993 Joshi et al. ..... 60/737
5,590,529 A * 1/1997 Joshi et al. ..... 60/737
5,623,827 A * 4/1997 Monty ..... 60/748
5,638,682 A * 6/1997 Joshi et al. ..... 60/737
5,865,609 A 2/1999 Sowa et al.
5,941,075 A * 8/1999 Ansart et al. ..... 60/748
6,354,072 B1 3/2002 Hura
6,367,262 B1 4/2002 Mongia et al.
6,381,964 B1 5/2002 Pritchard, Jr. et al.
6,418,726 B1 * 7/2002 Foust et al. ..... 60/776
6,453,660 B1 * 9/2002 Johnson et al. ..... 60/39.821
6,871,501 B2 * 3/2005 Bibler et al. ..... 60/772
6,986,255 B2 * 1/2006 Smith et al. ..... 60/776
7,007,479 B2 * 3/2006 Held et al. ..... 60/747
7,059,135 B2 * 6/2006 Held et al. ..... 60/776
7,114,337 B2 * 10/2006 Cazalens et al. ..... 60/737
7,185,497 B2 * 3/2007 Dudebout et al. ..... 60/776
2002/0092302 A1 * 7/2002 Johnson et al. ..... 60/737
2003/0131600 A1 * 7/2003 David et al. ..... 60/737

FOREIGN PATENT DOCUMENTS

DE 197 57 617 3/1999
EP 0 849 531 1/2000
EP 1 106 919 6/2001
EP 1 1 93 449 12/2002
EP 1 193 448 5/2003
WO WO 99/06767 2/1999

OTHER PUBLICATIONS

EPO Search Report Mar. 9, 2006 General Electric Company. European Search Report, Application No. 05257548.7 (Mar. 9, 2006).

* cited by examiner

*Primary Examiner*—William H. Rodriguez
(74) *Attorney, Agent, or Firm*—William Scott Andes; Armstrong Teasdale LLP

(57) ABSTRACT

A method for decreasing combustor acoustics in gas turbine engines is provided. The method includes fabricating a plurality of premixers, chamfering a trailing edge of a main swirler shroud of each premixer, coupling a respective one of the chamfered premixers to each of a plurality of combustor domes, and coupling the plurality of combustor domes to an inlet of a combustor in a circumferential arrangement such that, during operation, the chamfered edge facilitates reducing combustor acoustics.

18 Claims, 4 Drawing Sheets

METHOD AND APPARATUS FOR DECREASING COMBUSTOR ACOUSTICS

BACKGROUND OF THE INVENTION

This invention relates generally to combustors and, more particularly to a method and apparatus for decreasing combustor acoustics.

Air pollution concerns worldwide have led to stricter emissions standards both domestically and internationally. Pollutant emissions from industrial gas turbines are subject to Environmental Protection Agency (EPA) standards. These standards regulate the emission of oxides of nitrogen (NOx), unburned hydrocarbons (HC), and carbon monoxide (CO). With the continuing concerns for the environment, the trend toward more stringent emission standards can be expected to continue.

In general, engine emissions fall into two classes: those formed because of high flame temperatures (NOx), and those formed because of low flame temperatures that do not allow the fuel-air reaction to proceed to completion (HC & CO). In at least some engines, water is injected into the combustor to facilitate reducing flame temperature and thus (NOx) emissions. Alternatively, dry low emission (DLE) combustors are designed to facilitate reducing (CO) and (NOx) emissions without the use of water injection. However, to facilitate low emissions, the DLE combustor is run at lean fuel-air ratios which require uniform dispersion of fuel throughout the combustor. More specifically, such combustors include fuel delivery systems that circumferentially stage fuel flows through the premixers to facilitate evenly dispersing fuel throughout the combustor.

However, one problem that may arise with the DLE combustor and its associated fuel delivery system is the potential for high acoustics in the combustor. Combustor acoustics can result from several mechanisms, such as may be associated with thermally induced pressure disturbances resulting from instabilities or unsteadiness in heat released from the lean premixed flame. Such thermal instabilities can combine with natural acoustics generated within the combustor to produce high energy acoustic vibrations which over time may damage the combustor and other components. As a result, high combustor acoustics may limit the operation of the combustor.

BRIEF DESCRIPTION OF THE INVENTION

In one aspect, a method for decreasing combustor acoustics in gas turbine engines is provided. The method includes fabricating a plurality of premixers, chamfering a trailing edge of a main swirler shroud of each premixer, coupling a respective one of the chamfered premixers to each of a plurality of combustor domes, and coupling the plurality of combustor domes to an inlet of a combustor in a circumferential arrangement such that, during operation, the chamfered edge facilitates reducing combustor acoustics.

In another aspect, a fuel delivery apparatus for a dry low emission (DLE) combustor for a gas turbine engine is provided. The apparatus includes a plurality of combustor domes circumferentially arranged and coupled to the combustor inlet and a premixer coupled to a respective one of each of the plurality of domes. Each premixer includes a chamfered trailing edge configured to suppress coupling of a vortex shedding with acoustic vibrations in the combustor.

In another aspect, a gas turbine engine is provided that includes a combustor and a fuel delivery system coupled to the combustor. The fuel delivery system includes a plurality of combustor domes circumferentially arranged and coupled to an inlet of the combustor and a premixer coupled to a respective one of each of the plurality of domes. Each premixer includes a chamfered trailing edge configured to suppress coupling of a vortex shedding with acoustic vibrations in the combustor.

DETAILED DESCRIPTION OF THE INVENTION

Figure 1:
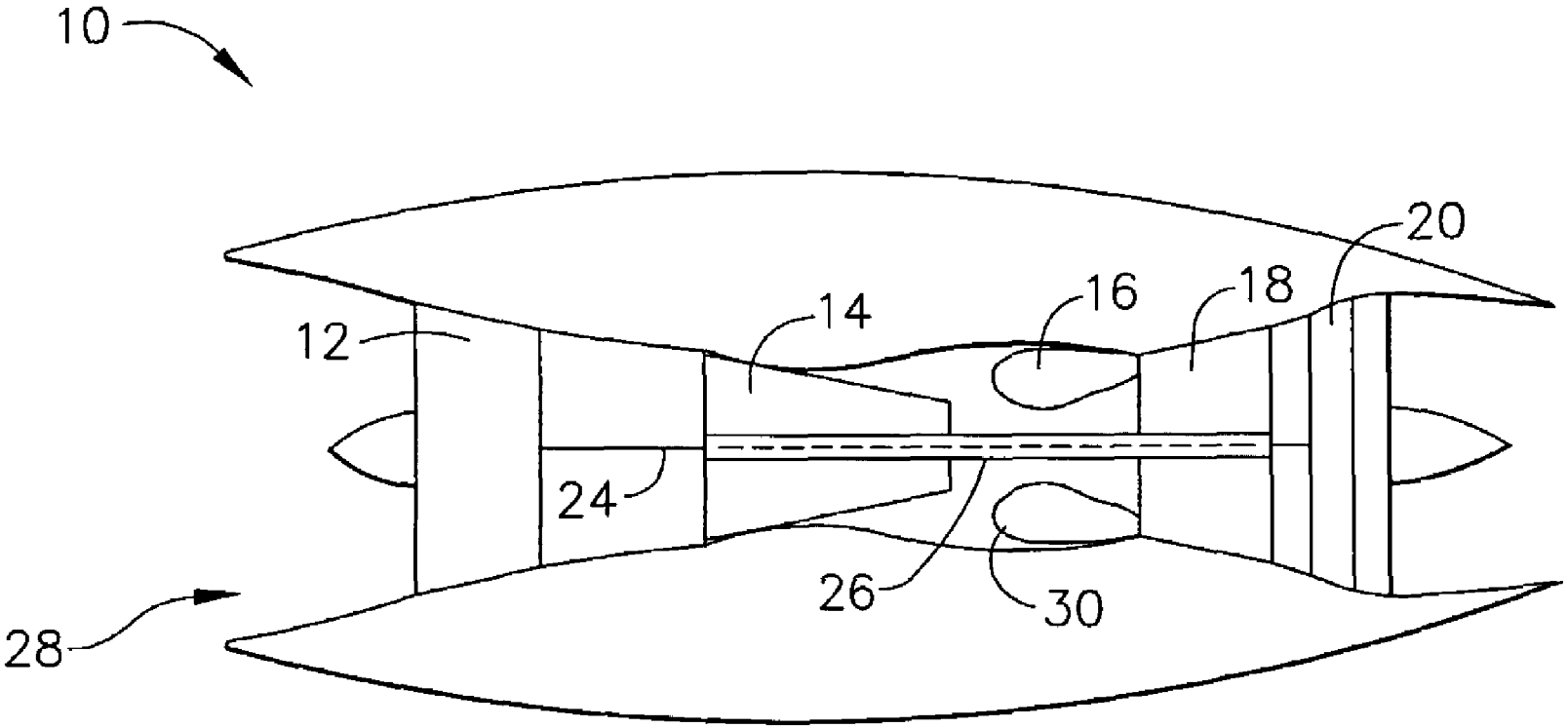
FIG. 1 is a schematic illustration of an exemplary gas turbine engine.

FIG. 1 is a schematic illustration of an exemplary gas turbine engine 10 including a low pressure compressor 12, a high pressure compressor 14, and a combustor 16. Engine 10 also includes a high pressure turbine 18, and a low pressure turbine 20 arranged in a serial, axial flow relationship. Compressor 12 and turbine 20 are coupled by a first shaft 24, and compressor 14 and turbine 18 are coupled by a second shaft 26. In one embodiment, gas turbine engine 10 is an LMS100 engine commercially available from General Electric Company, Cincinnati, Ohio.

In operation, air flows through low pressure compressor 12 from an upstream side 28 of engine 10. Compressed air is supplied from low pressure compressor 12 to high pressure compressor 14. Highly compressed air is then delivered to combustor assembly 16 where it is mixed with fuel and ignited. Combustion gases are channeled from combustor 16 to drive turbines 18 and 20.

Figure 2:
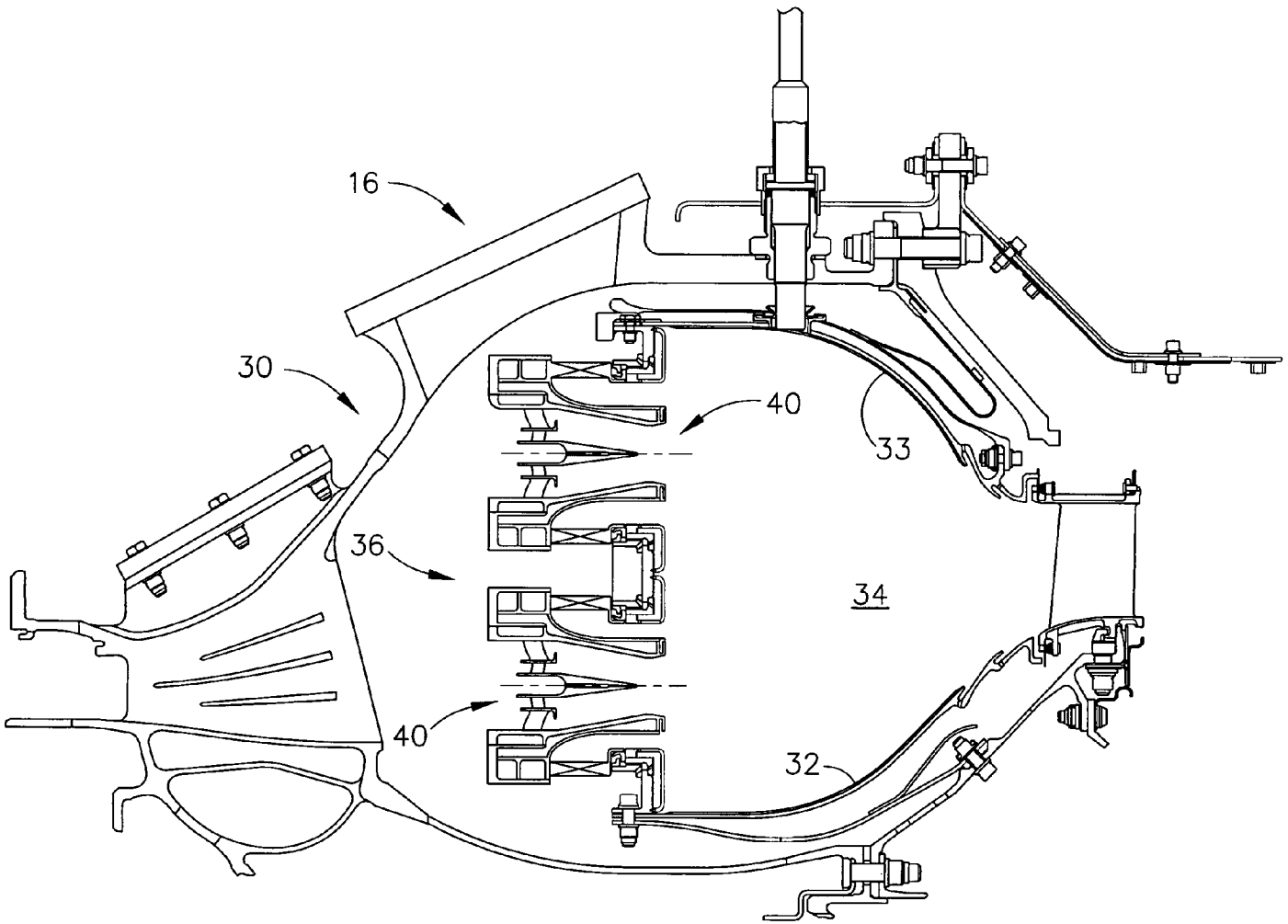
FIG. 2 is a cross-sectional view of an exemplary combustor that may be used with the gas turbine engine shown in FIG. 1.

FIG. 2 is a cross-sectional view of an exemplary combustor 16 that may be used with a gas turbine engine, such as engine 10 (shown in FIG. 1). In the exemplary embodiment, combustor 16 is a dry low emission (DLE) combustor that is designed to operate with reduced levels of (NOx). Combustor 16 operates with a lean fuel/air mixture. Specifically, combustor 16 is operable with a fuel/air mixture that contains more air than is required to fully combust all of the fuel in the mixture.

Combustor 16 includes a domed end 30 an inner liner 32 an outer liner 33. Inner liner 32 and outer liner 33 extend downstream from domed end 30 to define a combustion zone 34. A plurality of combustor domes 36 are mounted at an upstream end of liners 32 and 33 and are spaced radially across combustor 16. Each dome 36 includes a plurality of premixers 40 that facilitate mixing fuel and air to deliver a desired fuel/air mixture to combustion zone 34.

Figure 3:
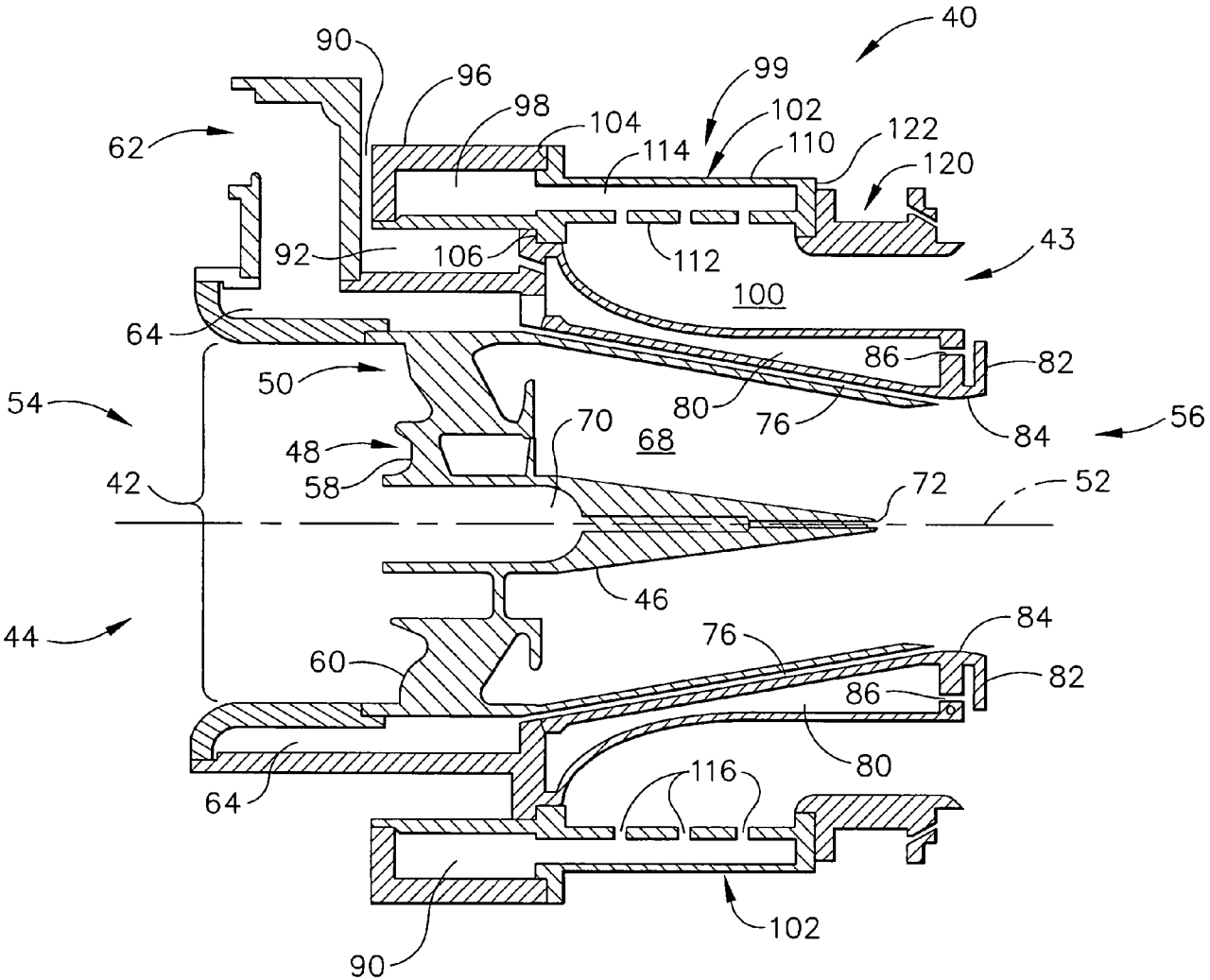
FIG. 3 is a cross sectional view of an exemplary combustor premixer that may be used with the combustor shown in FIG. 2.

FIG. 3 is a cross sectional view of a combustor premixer 40. In the exemplary embodiment, premixer 40 is a coaxially piloted premixer, and includes a pilot section 42 and a main section 43. Pilot section 42 includes a pilot inlet 44, a center body 46, an inner swirler 48, and an outer swirler 50. An axis of symmetry 52 of premixer 40 extends through premixer 40 from a forward end 54 of premixer 40 to an aft end 56 of premixer 40. Pilot inner swirler 48 includes inner swirler vanes 58 and pilot outer swirler 50 includes outer swirler vanes 60. In one embodiment, inner swirler 48 and outer swirler 50 are integrally formed with each other. Alternatively, inner swirler 48 and outer swirler 50 may be fabricated separately.

Premixer 40 also includes a pilot fuel inlet 62 that channels fuel into a pilot fuel manifold 64. Fuel and air are mixed in inner and outer swirlers 48 and 50, respectively, and the resulting mixture is channeled through pilot inner and outer swirler vanes 58 and 60, respectively, to an inner chamber 68 surrounding center body 46 prior to entering combustion zone 34. Center body 46 includes a cooling air passage 70 that routes cooling air through an outlet tip 72 of center body 46. Premixer 40 may be provided with an auxiliary fuel circuit that includes an auxiliary fuel passage 76 that is coupled in fluid communication with pilot fuel manifold 64. A cooling air manifold 80 surrounds fuel passageway 76, and a deflector plate 82 extends circumferentially around a downstream end 84 of cooling air manifold 80. Cooling air is discharged from cooling air manifold 80 through an orifice plate 86 to facilitate cooling deflector plate 82. A cooling air passage 90 delivers cooling air to a cooling air chamber 92 that supplies cooling air to cooling air manifold 80.

Premixer main section 43 is substantially concentrically aligned with respect to pilot section 42 and extends circumferentially around pilot section 42. An annular main fuel manifold 96 channels fuel from a fuel reservoir 98 to a main swirler 99 that mixes fuel and air to provide a desired lean fuel/air mixture to a outer chamber 100 within premixer 40 prior to entering combustion zone 34. A plurality of main swirler vanes 102 extend circumferentially around premixer 40 and are coupled to, and extend around, a trailing end 104 of main fuel manifold 96 and an edge 106 of cooling air manifold 80. Each main swirler vane 102 is hollow and includes an outer wall 110 and an inner wall 112 that define a cavity 114 therebetween. Cavity 114 extends along a longitudinal length of main swirler vanes 102. Main fuel manifold reservoir 98 extends into cavities 114 defined within main swirler vanes 102. In one embodiment, main swirler vanes 102 include a plurality of injection ports 116 that enable the adjustment the mixing of fuel and air to facilitate achieving low (NOx) emissions and combustion stability within combustor 16.

A main swirler shroud 120 is coupled to, and extends aftward from, an aft end 122 of main swirler vanes 102. Main swirler shroud 120 is annular and extends circumferentially around aft end 56 of premixer 40. An inner surface 124 of shroud 120 extends longitudinally toward aft end 56 and is substantially parallel to axis of symmetry 52.

Figure 4:
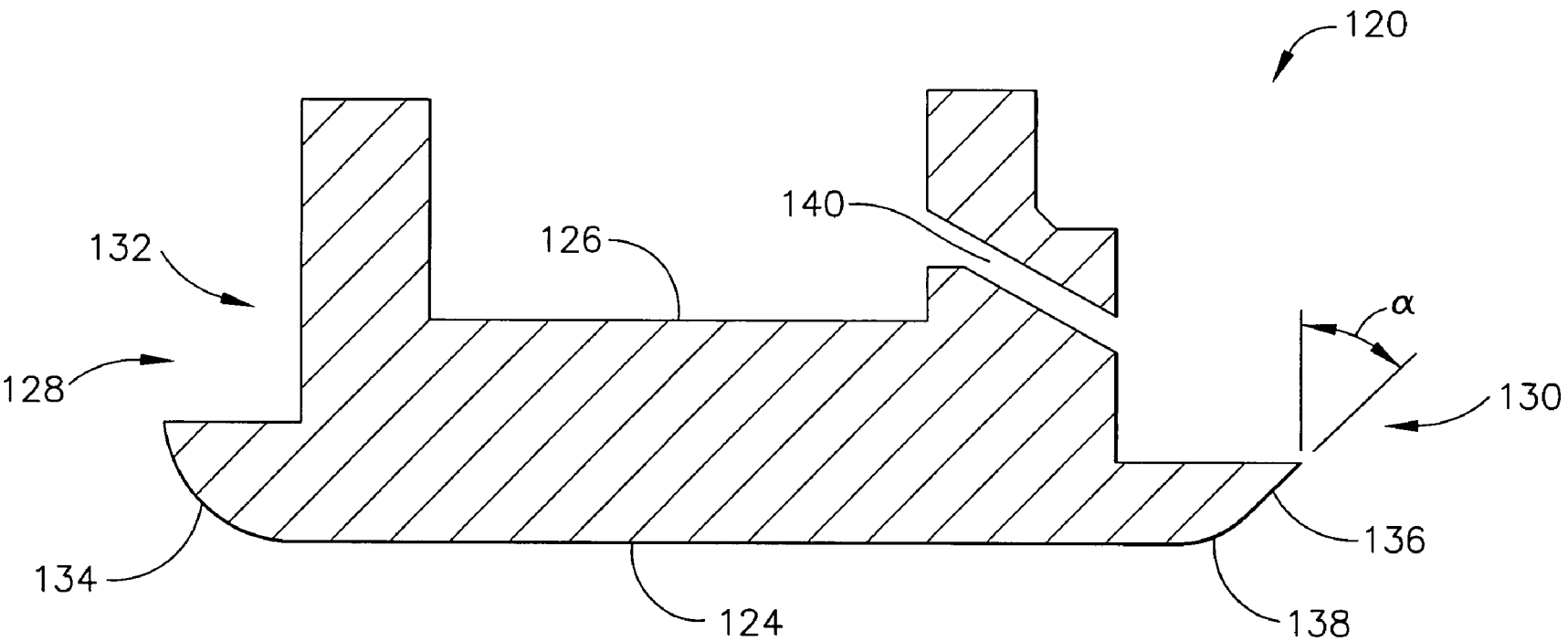
FIG. 4 is a cross-sectional view of an exemplary main swirler shroud that may be used with the premixer shown in FIG. 3.

FIG. 4 is a cross-sectional view of main swirler shroud 120. Main swirler shroud 120 includes a U-shaped outer surface 126 that is opposite inner surface 124, a forward end 128, and an aft or trailing end 130. Forward end 128 includes an L-shaped notch 132 that receives main swirler vane end 122. Inner surface 124 includes a forward edge 134 that is arcuate and is formed with a radius of curvature. Shroud 120 includes a chamfered trailing edge 136 that is formed at an angle $\alpha$ relative to inner surface 124. A rounded transition corner 138 extends between inner surface 124 and trailing edge 136. A cooling air passage 140 is provided to direct cooling air towards main swirler shroud trailing end 130.

During operation of engine 10, premixer 40 provides a lean, well-dispersed fuel/air mixture to combustor 16 to facilitate reducing (NOx) emissions from engine 10. Combustor 16 has naturally occurring acoustic frequencies that may be experienced during operation of engine 10. When operated under such lean conditions, high thermal acoustics can be produced in combustor 16. One potential source of high acoustics in DLE combustors, such as combustor 16, is associated with an interaction of flame acoustics in combustor 16 and a vortex shedding at trailing end 130 of main swirler shroud 120. This interaction is pronounced when trailing edge 136 is perpendicular with inner surface 124 forming a right angled corner. The vortex shedding has been empirically determined to cause oscillations in the fuel/air mixture and in the heat release from the lean premixed flame that can couple with the thermal acoustics in combustor 16. When such coupling occurs, high acoustics can result that can produce dangerous levels of acoustic vibrations.

Trailing edge 136 and transition corner 138 are oriented to alter the vortex shedding to facilitate suppressing excitation from vortex shedding at trailing edge 136 and transition corner 138 from a flow of fuel and air through premixer 40. The alteration in the vortex shedding produces changes in the vortex frequency and changes in local pressure distribution within and at an exit of main swirler shroud 120 that facilitate suppressing acoustic vibrations that may be generated in combustor 16. In the exemplary embodiment, angle $\alpha$ is approximately forty-five degrees measured relative to inner surface 124 of main swirler shroud 120.

The above-described fuel delivery system for a gas turbine engine is cost-effective and reliable. The fuel delivery system includes a dry low emission (DLE) premixer that facilitates minimizing (NOx) emissions while reducing the generation of potentially damaging acoustic vibrations. The premixer includes a main swirler shroud having a chamfered trailing edge that inhibits the coupling of pressure disturbances resulting from vortex shedding at the shroud trailing end with other combustor acoustics. The avoidance of such pressure disturbances facilitates the avoidance of damaging vibrations in the combustor and surrounding hardware.

Exemplary embodiments of a fuel delivery system for a gas turbine engine are described above in detail. The systems and assembly components are not limited to the specific embodiments described herein, but rather, components of each system may be utilized independently and separately from other components described herein. Each system and assembly component can also be used in combination with other systems and assemblies.

While the invention has been described in terms of various specific embodiments, those skilled in the art will recognize that the invention can be practiced with modification within the spirit and scope of the claims.

What is claimed is:

1. A method for assembling a combustor in gas turbine engines comprising:

providing a plurality of premixers that include a main swirler including a plurality of main swirler vanes;

coupling a deflector plate to each premixer, such that the deflector plate is positioned downstream from the plurality of main swirler vanes;

chamfering a trailing edge of the main swirler shroud of each premixer, wherein the chamfered trailing edge is positioned downstream with respect to a centerline of the gas turbine engine, from the plurality of main swirler vanes and upstream from the deflector plate with respect to the centerline;

coupling a respective one of the chamfered premixers to each of a plurality of combustor domes; and coupling the plurality of combustor domes to an inlet of a combustor in a circumferential arrangement such that, during operation, the chamfered edge facilitates reducing combustor acoustics.

2. A method in accordance with claim 1 wherein chamfering a trailing edge of the main swirler shroud comprises chamfering a trailing edge of the main swirler shroud at an angle determined to suppress coupling of a vortex shedding at an outlet of said main swirler shroud with acoustic vibrations in the combustor.

3. A method in accordance with claim 2 wherein chamfering a trailing edge of the main swirler shroud at an angle determined to suppress a vortex shedding comprises chamfering a trailing edge of the main swirler shroud at an angle of approximately forty-five degrees relative to an inner surface of the main swirler shroud.

4. A method in accordance with claim 1 wherein providing a plurality of premixers comprises providing a plurality of dry low emission (DLE) premixers.

5. A fuel delivery apparatus for a dry low emission (DLE) combustor for a gas turbine engine comprising:

a plurality of combustor domes circumferentially arranged and coupled to a combustor inlet; and a premixer coupled to a respective one of each of said plurality of domes, each said premixer comprising:

a main swirler comprising a plurality of main swirler vanes;

a deflector plate that is positioned downstream from said plurality of main swirler vanes; and a chamfered trailing edge defined on a main swirler shroud and positioned downstream with respect to a centerline of the gas turbine engine, from said plurality of main swirler vanes and upstream from said deflector plate with respect to the centerline, said chamfered trailing edge is configured to suppress coupling of a vortex shedding with acoustic vibrations in the combustor.

6. A fuel delivery apparatus in accordance with claim 5 wherein each said premixer further comprises a main swirler shroud and said chamfered trailing edge is positioned on said main swirler shroud.

7. A fuel delivery apparatus in accordance with claim 6 wherein said main swirler shroud includes an inner surface and said chamfered trailing edge is located at an aft end of said inner surface.

8. A fuel delivery apparatus in accordance with claim 7 wherein said chamfered trailing edge is formed at an angle of approximately forty-five degrees relative to said inner surface of said main swirler shroud.

9. A fuel delivery apparatus in accordance with claim 7 wherein said main swirler shroud further comprises a rounded transition corner joining said chamfered trailing edge to said inner surface.

10. A fuel delivery apparatus in accordance with claim 6 wherein said chamfered trailing edge is angled to facilitate altering a local pressure distribution within said main swirler shroud.

11. A fuel delivery apparatus in accordance with claim 5 wherein each said premixer comprises a dry low emission (DLE) premixer.

12. A gas turbine engine comprising:

a combustor; and a fuel delivery system coupled to said combustor, said fuel delivery system comprising:

a plurality of combustor domes circumferentially arranged and coupled to an inlet of said combustor; and a premixer coupled to a respective one of each of said plurality of domes, each said premixer comprising:

a main swirler comprising a plurality of main swirler vanes;

a deflector plate that is positioned downstream from said plurality of main swirler vanes; and a chamfered trailing edge defined on a main swirler shroud and positioned downstream with respect to a centerline of said gas turbine engine, from said plurality of main swirler vanes and upstream from said deflector plate with respect to the centerline, said chamfered trailing edge is configured to suppress coupling of a vortex shedding with acoustic vibrations in the combustor.

13. A gas turbine engine in accordance with claim 12 wherein each said premixer further comprises a main swirler shroud and said chamfered trailing edge is positioned on said main swirler shroud.

14. A gas turbine engine in accordance with claim 13 wherein said chamfered trailing edge is angled to facilitate altering a local pressure distribution within said main swirler shroud.

15. A gas turbine engine in accordance with claim 13 wherein said main swirler shroud includes an inner surface and said chamfered trailing edge is located at an aft end of said inner surface.

16. A gas turbine engine in accordance with claim 15 wherein said chamfered trailing edge is formed at an angle of approximately forty-five degrees measured relative to said inner surface of said main swirler shroud.

17. A gas turbine engine in accordance with claim 15 wherein said main swirler shroud further comprises a rounded transition corner joining said chamfered trailing edge to said inner surface.

18. A gas turbine engine in accordance with claim 12 wherein each said premixer comprises a dry low emission (DLE) premixer.

* * * * *